US005809790A

United States Patent [19]

Kwon

[11] Patent Number: 5,809,790

[45] Date of Patent: Sep. 22, 1998

[54] OPERATION CONTROL DEVICE FOR A REFRIGERATOR AND METHOD THEREOF

[75] Inventor: Young-Woon Kwon, Suwon, Rep. of Korea

[73] Assignee: Samsung Electronics Co., Ltd., Suwon, Rep. of Korea

[21] Appl. No.: 908,946

[22] Filed: Aug. 8, 1997

[30] Foreign Application Priority Data

Aug. 12, 1996 [KR] Rep. of Korea ..... 96-33424

[51] Int. Cl.[6] ..... F25D 17/04; F25D 17/00

[52] U.S. Cl. ..... 62/89; 62/187; 236/37

[58] Field of Search ..... 62/180, 179, 187, 62/208, 89; 236/37

[56] References Cited

U.S. PATENT DOCUMENTS 5,156,015 10/1992 Chung ..... 62/187

5,487,277 1/1996 Bessler ..... 62/187

FOREIGN PATENT DOCUMENTS 0 075 840 3/1989 Japan ..... 236/37

*Primary Examiner*—William E. Wayner

*Attorney, Agent, or Firm*—Burns, Doane, Swecker & Mathis, L.L.P.

[57] ABSTRACT

An operation control device for a refrigerator which can maintains freshness of food and drink for a long time by supplying a cold-storage room with cool air remaining in an evaporator by opening a cold-storage room damper and driving a fan motor until a present temperature of the evaporator sensed by an evaporator temperature sensor is above the temperature of the evaporator sensed while the driving of a compressor motor is stopped, by a predetermined temperature if the present temperature of the cold-storage room sensed by a cold-storage room temperature sensor is above a predetermined temperature set in the cold-storage room while the driving of the compressor motor is stopped.

2 Claims, 3 Drawing Sheets

OPERATION CONTROL DEVICE FOR A REFRIGERATOR AND METHOD THEREOF

BACKGROUND OF THE INVENTION

A. Field of the Invention

The present invention relates to an operation control device for a refrigerator and method thereof. More particularly, the present invention relates to an operation control device for a refrigerator and method thereof which can prevent internal temperature of a cold-storage room from rising when the driving of a compressor is stopped.

B. Description of the Related Art

A conventional method for refrigerating a cold-storage room and a refrigerating room of a refrigerator is explained hereinafter with reference to FIG. 1.

First, refrigerant is compressed to high temperature and high pressure gas, and the gas flows into a condenser 12. At the same time, heat is exchanged with external air, and refrigerated to low temperature and high pressure refrigerant, thereby turning to liquid. While low temperature and high pressure liquid refrigerant liquefied by the condenser 12 passes through a capillary tube (not shown), the liquid refrigerant reduced to the low temperature and high pressure refrigerant with no shape which is liable to evaporate, and flows into an evaporator 14.

Next, while the low temperature and low pressure refrigerant passes through several pipes forming the evaporator 14, the refrigerant is evaporated whereby the air is exchanged with cool air. The low temperature and low pressure gas refrigerant refrigerated in the evaporator 14 flows into a compressor 10 again, whereby forming a refrigerating cycle which repeats the above-mentioned steps.

Here, the cool air of which heat is exchanged by the evaporator 14 is forcedly sent to a refrigerating room 18 and a cold-storage room 20 of a refrigerator by a fan 16, thereby maintaining freshness of food and drink kept in the cold-storage room and the refrigerating room.

On the other hand, a cold-storage room damper 22 is formed on a path of the cool air sent to the cold-storage room 20, and the cold-storage room damper 22 is opened/closed in response to a control signal outputted from a controller. The cool air generated from the evaporator 14 and sent by a fan 16 is supplied to the cold-storage room 20 or blocked by the opening/closing operation of the cold-storage room damper 22, whereby an internal temperature is maintained above a predetermined temperature (generally, +3° C.) set in the cold-storage room 20.

That is to say, the cold-storage room damper 22 is opened in response to the control signal outputted from the controller when the internal temperature in the cold-storage room 20 is above +3° C., and the cool air from the evaporator 14 sent by the fan 16 is supplied to the cold-storage room 20, thereby cooling the internal temperature of the cold-storage room 20.

On the other hand, the cold-storage room damper 22 is closed in response to the control signal outputted from the controller when the internal temperature in the cold-storage room 20 is below +3° C., and the cool air from the evaporator 14 supplied to the cold-storage room 20 is blocked, thereby maintaining the internal temperature of the cold-storage room 20 of the predetermined temperature (+3° C.).

However, the driving of a compressor motor is stopped by the control signal outputted from the controller when the internal temperature of the refrigerating room 18 is blow a predetermined temperature (generally, −18° C.). Here, the conventional cooling device and method has a disadvantage in that the freshness of food and drink kept in the cold-storage room is not maintained for a long time because the cool air can not be supplied to the cold-storage room 20 if the cold-storage room damper 22 is closed even though the internal temperature of the cold-storage room 20 rises above the predetermined temperature (generally, +3° C.).

SUMMARY OF THE INVENTION

Accordingly, the object of the present invention is to provide an operation control device for a refrigerator and method thereof which can maintain freshness of food and drink for a long time by opening a cold-storage room damper, driving a fan motor, and thereby supplying the cold-storage room with cool air remaining in an evaporator when an internal temperature of the cold-storage room rises above a predetermined temperature while the driving of a compressor motor is stopped to substantially obviate one or more of the problems due to limitations and disadvantages of the related art.

To achieve the object and in accordance with the purpose of the invention, as embodied and broadly described herein, an operation control device for a refrigerator having a refrigerating room temperature sensor for sensing a present temperature of a refrigerating room, a compressor motor for circulating refrigerant according to the present temperature sensed by the refrigerating room temperature sensor, thereby generating cool air through an evaporator, a fan motor for driving a fan and supplying the refrigerating room with the cool air generated from the evaporator, a cold-storage room temperature sensor for sensing the present temperature of the cold-storage room, a cold-storage room damper for supplying the cold-storage room with the cool air, thereby refrigerating food and drink, and an evaporator temperature sensor for sensing the present temperature of the evaporator, characterized in that the operation control device for a refrigerator comprises a controller for outputting a control signal for supplying the cold-storage room with the cool air remaining in the evaporator by opening the cold-storage room damper and driving the fan motor until the present temperature of the evaporator sensed by the evaporator temperature sensor is above the temperature of the evaporator sensed while the driving of the compressor motor is stopped, by a predetermined temperature if the present temperature of the cold-storage room sensed by the cold-storage room temperature sensor is above a predetermined temperature set in the cold-storage room while the driving of the compressor motor is stopped.

According to another aspect of the present invention, a method for controlling an operation control device for a refrigerator which refrigerates food and drink in a refrigerating room and a cold-storage room by driving a compressor motor, circulating refrigerant, thereby generating cool air through an evaporator, characterized in that the method comprises the steps of:

comparing a present temperature of the cold-storage room sensed by a cold-storage room temperature sensor with a predetermined temperature set in the cold-storage room while the compressor motor is driven, and refrigerating the cold-storage room by opening/closing the cold-storage room according to a comparison result;

comparing a present temperature of the refrigerating room sensed by a refrigerating room temperature sensor with a predetermined temperature set in the refrigerating room, and refrigerating the refrigerating room by driving the compressor motor according to the comparison result; and supplying the cold-storage room with the cool air remaining in the evaporator by opening the cold-storage room damper and driving the fan motor until the present temperature of the evaporator sensed by the evaporator temperature sensor is above the temperature of the evaporator sensed while the driving of the compressor motor is stopped, by a predetermined temperature if the present temperature of the cold-storage room sensed by the cold-storage room temperature sensor is above a predetermined temperature set in the cold-storage room while the driving of the compressor motor is stopped.

Additional objects and advantages of the invention are set forth in part in the description which follows, and in part will be obvious from the description, or may be learned by practice of the invention. The objects and advantages of the invention will be realized and attained by means of the elements and combinations particularly pointed out in the appended claims.

BRIEF DESCRIPTION OF THE DRAWINGS

The accompanying drawings, illustrate an embodiment of the invention and, together with the description, serve to explain the principles of the invention.

In the drawings.

DESCRIPTION OF THE PREFERRED EMBODIMENT

Figure 1:
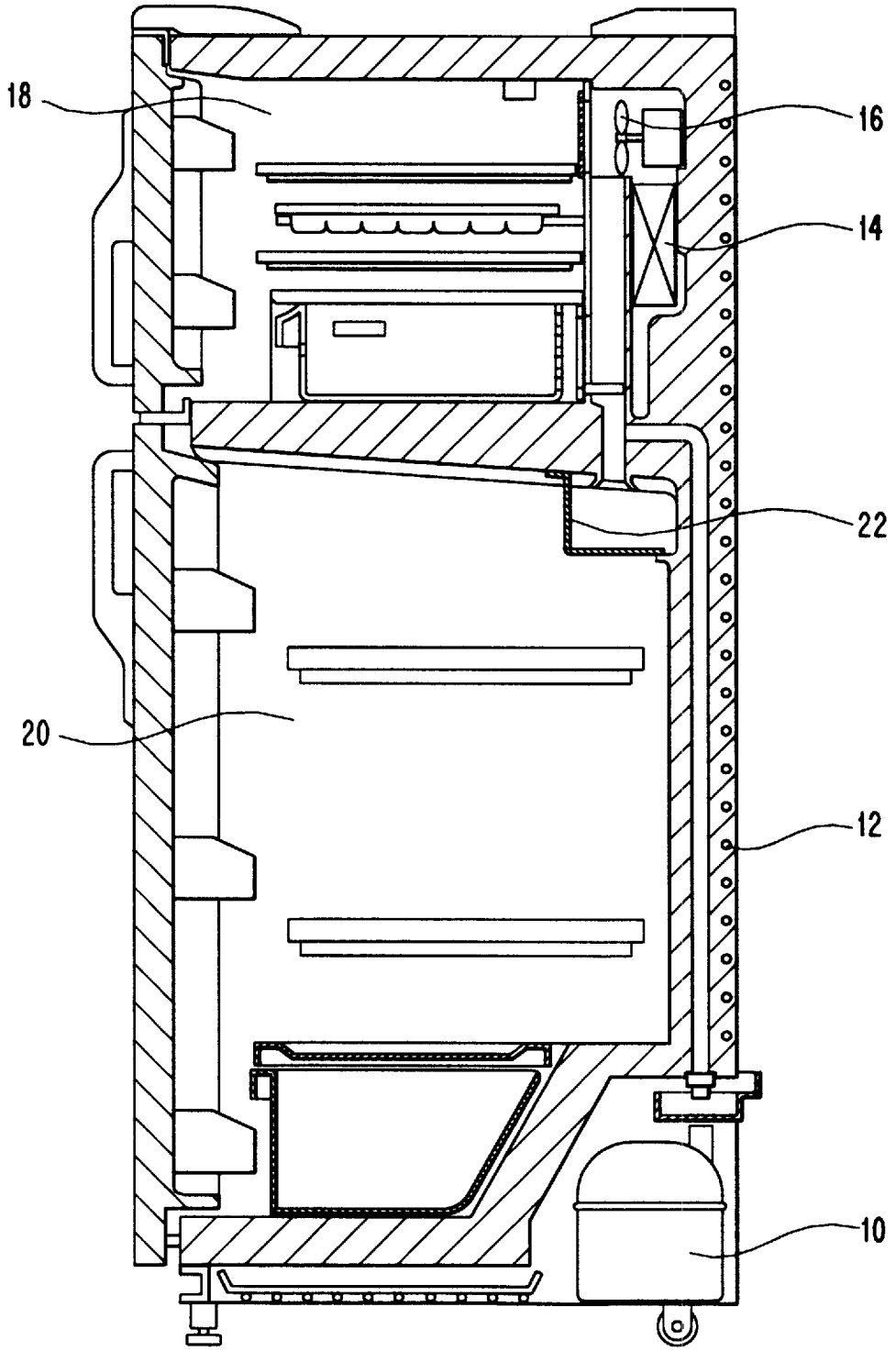
FIG. 1 (PRIOR ART)
FIG. 1 is a view illustrating a cooling method of a conventional refrigerator.

Reference will now be made in detail to a preferred embodiment of the present invention, an example of which is illustrated in the accompanying drawings. Same reference numerals are indicated to same portions as portions in FIG. 1, and explanation thereof is omitted.

Figure 2:
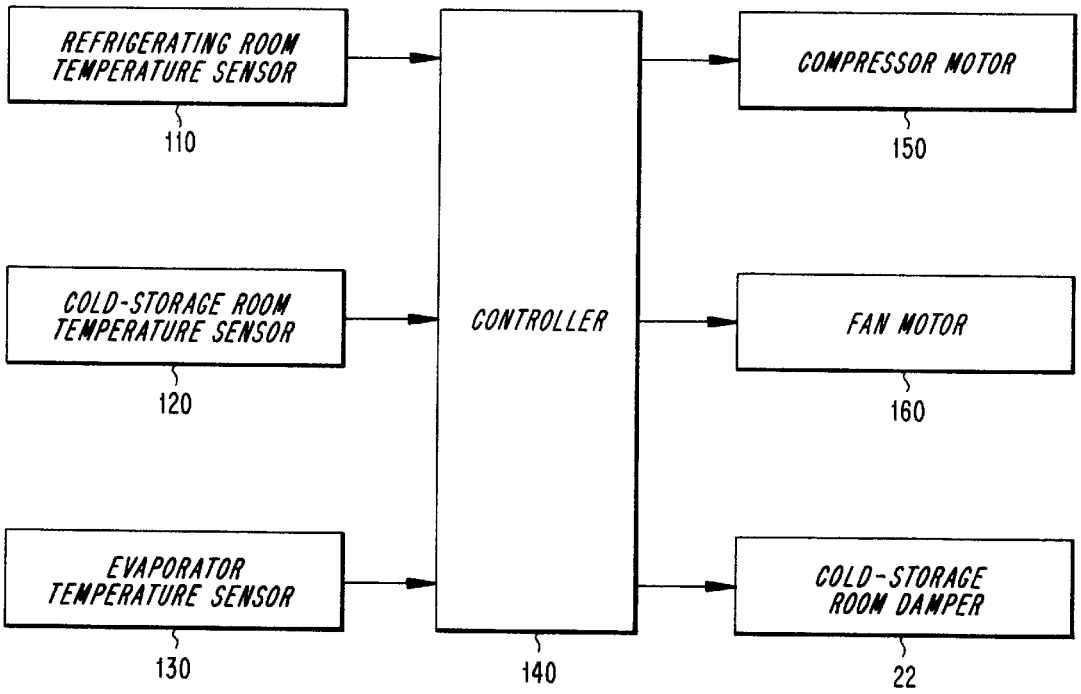
FIG. 2 is a schematic block diagram of an operation control device for a refrigerator according to a preferred embodiment of the present invention.

Referring to FIG. 2, an operation control device for a refrigerator according to the preferred embodiment of the present invention comprises a refrigerating room temperature sensor 110, a cold-storage room temperature sensor 120, an evaporator temperature sensor 130, a controller 140, a compressor motor 150, a fan motor 160 and a cold-storage room damper 22.

As shown in FIG. 2, the refrigerating room temperature sensor 110 senses a present temperature of a refrigerating room 18, and inputs information about the present temperature to the controller 140. The evaporator temperature sensor 130 senses the present temperature of the evaporator 14 (not shown), and inputs the information about the present temperature to the controller 140.

The controller 140 outputs a control signal for driving the compressor motor 150 when the present temperature of the refrigerating room 18 sensed by the refrigerating room temperature sensor 110 is above a predetermined temperature set in the refrigerating room 18 (generally, −18° C). The controller 140 outputs a control signal for driving the fan motor 160 after a predetermined interval (for example, one minute), and outputs a control signal for stopping the driving of the compressor motor 150 and the fan motor 160 when the present temperature of the refrigerating room 18 sensed by the refrigerating room temperature sensor 110 is below a predetermined temperature set in the refrigerating room 18 (generally, −18° C).

On the other hand, the controller 140 outputs a control signal for opening the cold-storage room damper 22 when the present temperature of the cold-storage room 20 sensed by the cold-storage room temperature sensor 120 is above a predetermined temperature set in the cold-storage room 20 (generally, +3° C.), and outputs a control signal for closing the cold-storage room damper 22 when the present temperature of the cold-storage room 20 sensed by the cold-storage room temperature sensor 120 is below a predetermined temperature set in the cold-storage room 20 (generally, +3° C.).

In addition, the controller 140 outputs a control signal for opening the cold-storage room damper 22 and a control signal for driving the fan motor 160 in order to send cool air remaining in the evaporator 14 to the cold-storage room 20. On the other hand, the controller 140 outputs a control signal for stopping the driving of the fan motor 160 if the present temperature of the evaporator 14 sensed by the evaporator temperature sensor 130 is above a predetermined temperature (preferably, 2° C.) when the driving of the compressor motor 150 is stopped.

The compressor motor 150 circulates refrigerant by driving the compressor 10 in response to the control signal outputted from the controller 140, and the fan motor 160 supplies the refrigerating room 18 and the cold-storage room 20 with the cool air produced when heat is exchanged through the evaporator 14 by driving the fan motor 16 in response to the control signal outputted from the controller 140, and the cold-storage room damper 22 is opened/closed in response to the control signal outputted from the controller 140.

Figure 3:
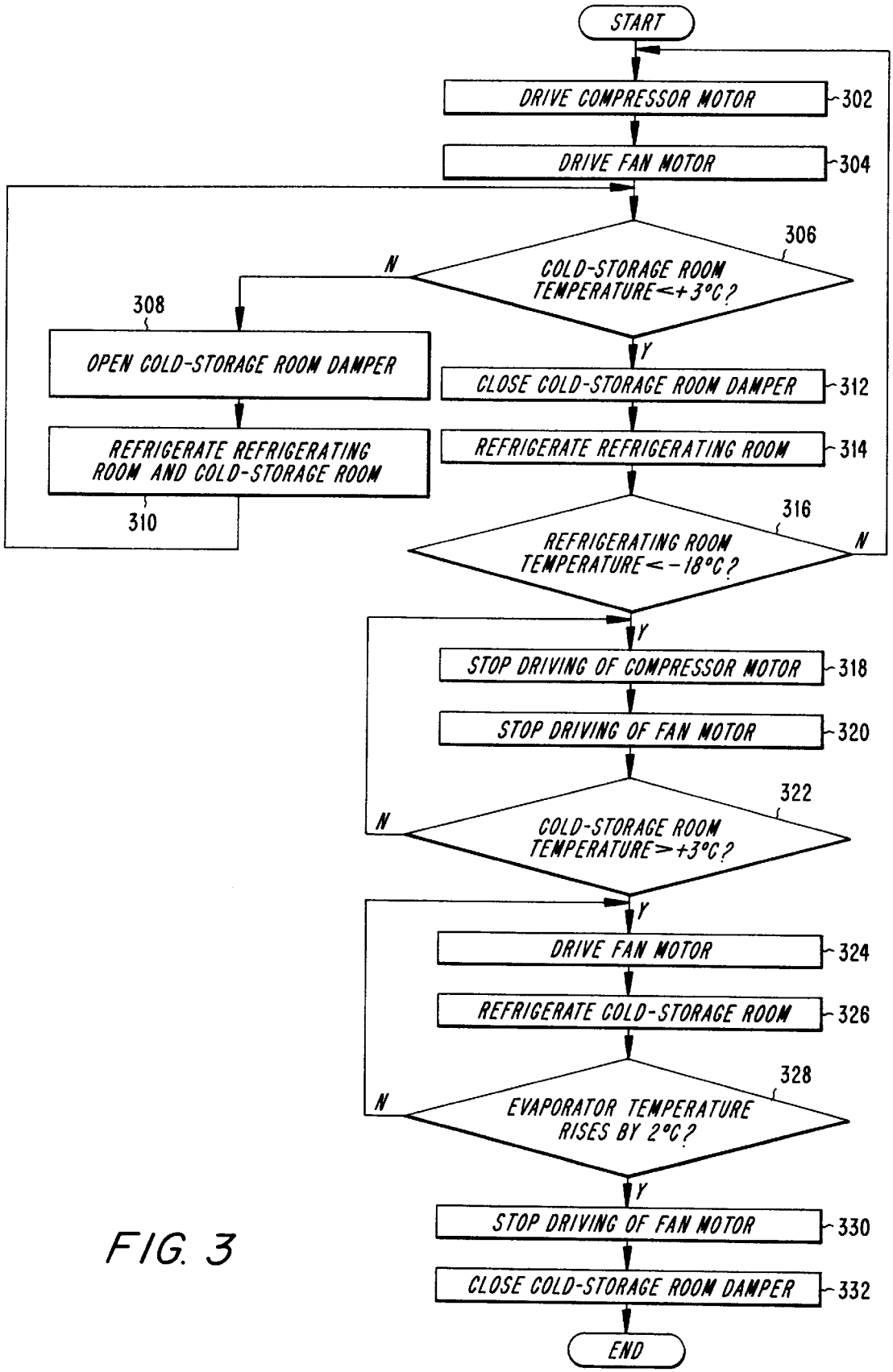
FIG. 3 is flow chart of the steps in a method for controlling an operation of a refrigerator according to a preferred embodiment of the present invention.

Hereinafter, the operation control device for a refrigerator and method thereof according to the preferred embodiment of the present invention are explained in detail with reference to FIGS. 2 and 3.

First, the compressor motor 150 is driven by the control signal outputted from the controller 140 when the present temperature of the refrigerating room 18 sensed by the refrigerating room temperature sensor 110 is above the predetermined temperature set in the refrigerating room 18 (Step 302). The refrigerant is circulated by the driving of the compressor motor 150, whereby the cool air is generated from the evaporator 14.

The fan motor 160 is driven by the control signal outputted from the controller 140 after the predetermined time (preferably, one minute) passes by (Step 304). The fan 16 is driven by the driving of the fan motor 160, whereby the cool air produced from the evaporator 14 is forcedly sent to the refrigerating room 18 and the cold-storage room 20.

On the other hand, the controller 140 compares the present temperature of the cold-storage room 20 sensed by the cold-storage room temperature sensor 120 with the predetermined temperature (+3° C.) set in the cold-storage room 20 (Step 306). The controller 140 outputs a control signal for opening the cold-storage room damper 22 when the present temperature of the cold-storage room 20 sensed by the cold-storage room temperature sensor 120 is above the predetermined temperature (+3° C). The cold-storage room damper 22 is opened by the control signal outputted from the controller 140 (Step 308), the cool air generated from the evaporator 14 is supplied to the refrigerating room 18 and the cold-storage room 20, whereby the refrigerating room 18 and the cold-storage room 20 are refrigerated (Step 310).

The controller 140 outputs a control signal for closing the cold-storage room damper 22 when the present temperature of the cold-storage room 20 sensed by the cold-storage room temperature sensor 120 is below the predetermined temperature (+3° C.) set in the cold-storage room 20, and the cold-storage room damper 22 is closed by the control signal outputted from the controller 140 (Step 312). Here, the cold-storage room 20 is not refrigerated any longer. The cool air generated from the evaporator 14 is supplied to the refrigerating room 18, whereby the refrigerating room 18 is continuously refrigerated (Step 314).

On the other hand, the controller 140 compares the present temperature of the refrigerating room 18 sensed by the refrigerating room temperature sensor 110 with the predetermined temperature (−18° C.) set in the refrigerating room 18 (Step 316) while the refrigerating room 18 is continuously refrigerated. The controller 140 outputs a control signal for stopping the driving of the compressor motor 140 and the fan motor 160 when the present temperature of the refrigerating room 18 sensed by the refrigerating room temperature sensor 110 is below the predetermined temperature (−18° C.), and the driving of the compressor motor 140 and the fan motor 160 is stopped by the control signal outputted from the controller 140 (Steps 318 and 320).

The controller 140 compares the present temperature of the cold-storage room 20 sensed by the cold-storage room temperature sensor 120 with the predetermined temperature (+3° C) set in the cold-storage room 20 while the compressor motor 150 and the fan motor 160 are driven (Step 322). The controller 140 outputs a control signal for opening the cold-storage room damper 22 in order to supply the cold-storage room 20 with the cool air remaining in the evaporator 14 when the present temperature of the cold-storage room 20 sensed by the cold-storage room temperature sensor 120 is above the predetermined temperature (+3° C.) set in the cold-storage room 20, and at the same time outputs a control signal for driving the fan motor 160.

Accordingly, the cold-storage room damper 22 is opened by the control signal outputted from the controller 140, and at the same time the fan motor 160 is driven (Step 324). The fan 16 is driven by the driving of the fan motor 22, and the cool air remaining in the evaporator 14 is supplied to the cold-storage room 20, whereby the cold-storage room 20 is refrigerated (Step 326).

The controller 140 checks the present temperature of the evaporator 14 sensed by the evaporator temperature sensor 130 while the cold-storage room 20 is refrigerated by the cool air sent from the evaporator 14. The controller 140 outputs a control signal for stopping the driving of the fan motor 160 when the present temperature of the evaporator 14 sensed by the evaporator temperature sensor 130 is above the temperature of the evaporator 14 sensed when the driving of the compressor motor 150 is stopped, by the predetermined temperature (preferably, 2° C.), and at the same time outputs a control signal for closing the cold-storage room damper 22.

Accordingly, the driving of the fan motor 160 is stopped by the control signal outputted from the controller 140, and the cold-storage room damper 22 is closed, whereby the cool air supplied from the evaporator to the cold-storage room 20 is blocked 15 (Step 332).

Here, the reason why the driving of the fan motor 160 and the cold-storage room damper 22 is closed when the present temperature of the evaporator 14 sensed by the evaporator temperature sensor 130 is above the temperature of the evaporator 14 sensed when the driving of the compressor motor 150 is stopped, by the predetermined temperature (preferably, 2° C.), is as follows.

The rising of the temperature of the cold-storage room 20 is prevented because the fan motor 160 is driven for a long time while the driving of the compressor motor 150 is stopped, and the power consumption is prevented because the driving of the compressor motor 150 is stopped temporarily.

As described above, the effect of the present invention lies in that the freshness of food and drink in the cold-storage room can be maintained for a long time by refrigerating the cold-storage room using the cool air remaining in the evaporator if the internal temperature of the cold-storage room rises while the driving of the compressor motor is stopped.

Other embodiments of the invention will be apparent to the skilled in the art from consideration of the specification and practice of the invention disclosed herein. It is intended that the specification and examples be considered as exemplary only, with the true scope and spirit of the invention being indicated by the following claims.

What is claimed is:

1. An operation device for a refrigerator having a refrigerating room temperature sensor for sensing a present temperature of a refrigerating room, a compressor motor for circulating refrigerant according to the present temperature sensed by the refrigerating room temperature sensor, thereby generating cool air through an evaporator, a fan motor for driving a fan and supplying the refrigerating room with the cool air generated from the evaporators cold-storage room temperature sensor for sensing the present temperature of the cold-storage room, a cold-storage room damper for supplying the cold-storage room with the cool air, thereby refrigerating food and drink, and an evaporator temperature sensor for sensing the present temperature of the evaporator, characterized in that the operation control device for a refrigerator comprises a controller for outputting a control signal for supplying the cold-storage room with the cool air remaining in the evaporator by opening the cold-storage room damper and driving the fan motor until the present temperature of the evaporator sensed by the evaporator temperature sensor is above the temperature of the evaporator sensed while the driving of the compressor motor is stopped, by a predetermined temperature if the present temperature of the cold-storage room sensed by the cold-storage room temperature sensor is above a predetermined temperature set in the cold-storage room while the driving of the compressor motor is stopped.

2. A method for controlling an operation control device for a refrigerator which refrigerates food and drink in a refrigerating room and a cold-storage room by driving a compressor motor, circulating refrigerant, thereby generating cool air through an evaporator, characterized in that the method comprises the steps of:

comparing a present temperature of the cold-storage room sensed by a cold-storage room temperature sensor with a predetermined temperature set in the cold-storage room while the compressor motor is driven, and refrigerating the cold-storage room by opening/closing a cold-storage room according to a comparison result;

comparing a present temperature of the refrigerating room sensed by a refrigerating room temperature sensor with a predetermined temperature set in the refrigerating room, and refrigerating the refrigerating room by driving the compressor motor according to the comparison result; and supplying the cold-storage room with the cool air remaining in the evaporator by opening the cold-storage room damper and driving the fan motor until the present temperature of the evaporator sensed by the evaporator temperature sensor is above the temperature of the evaporator sensed while the driving of the compressor motor is stopped, by a predetermined temperature if the present temperature of the cold-storage room sensed by the cold-storage room temperature sensor is above a predetermined temperature set in the cold-storage room while the driving of the compressor motor is stopped.

* * * * *